United States Patent [19]

Kauffman

[11] Patent Number: 4,569,491

[45] Date of Patent: Feb. 11, 1986

[54] SPOOL PACKAGE

[75] Inventor: John C. Kauffman, Fort Wayne, Ind.

[73] Assignee: Phelps Dodge Industries, Inc., New York, N.Y.

[21] Appl. No.: 634,039

[22] Filed: Jul. 24, 1984

[51] Int. Cl.[4] ..... B65H 75/20

[52] U.S. Cl. ..... 242/118.41; 242/77.1

[58] Field of Search ..... 242/71.9, 118.4, 118.41, 242/118.5, 55.3, 77.1, 77.2, 77.3

[56] References Cited

U.S. PATENT DOCUMENTS 1,557,424 10/1925 Conant ..... 242/71.9

2,526,440 10/1950 Toombs ..... 242/55.3

*Primary Examiner*—Leonard D. Christian

*Attorney, Agent, or Firm*—David A. Lundy

[57] ABSTRACT

An improved spool for packaging and handling ribbon material or cable. The spool has a cylindrical hub with a central spindle opening extending therethrough, two opposite flange portions, and one or more central flange portions. Each of the flange portions is disk shaped and radially extends outwardly from the hub.

15 Claims, 6 Drawing Figures

SPOOL PACKAGE

BACKGROUND OF THE INVENTION

The present invention relates to spools and packages for ribbon material, and particularly, to a spool for packaging ribbon cables in which a plurality of insulated magnet wire conductors are juxtaposed, in side by side relationship defining a generally rectangular cross-section.

Spools have long been used to package and otherwise handle magnet wire, cables and other filaments. While other packages have been devised in which the magnet wire is more or less laid in the package rather than spooled, spools and reels have become widely known in the magnet wire industry such that relatively standard sizes are used, and both high speed take-up and pay-out apparatus have been proposed and used, for many years.

However, ribbon cables pose new interesting problems for packaging. Ribbon cables are now being proposed by which an unlimited number of insulated conductors are disposed in a side to side relationship and bonded together to form a cable having a relatively thin elongated rectangular cross-section. Spooling such cables for handling and/or shipping, becomes a problem using conventional spools which have a barrel and two spaced apart flange portions. With such ribbon cable and conventional spools either a relatively small amount of cable is placed on each spool or the spools become larger in diameter than desired.

In an application where transposed ribbon cable is made by folding ribbon cable of the type above-described, either the take-up or pay-off spools must be mounted on a yoke and spindle and rotated both about the spindle and about a yoke axis which is generally perpendicular to the spindle. In these and other applications, the handling of relatively large spools is not desired.

It is therefore highly desirable to provide an improved spool or reel for handling and packaging ribbon material or a ribbon cable comprising an unlimited number of conductors in side by side relation bonded together and having a generally rectangular cross-section, an improved spool or reel by which an optimum amount of ribbon material or cable can be placed for handling or shipment without the size of the spool or reel becoming unmanageable in normal operations, an improved reel or spool for ribbon material or cable which generally has the exterior geometric configuration of conventional spools and reels, an improved spool or reel for ribbon material or cable on which a larger amount of ribbon material or cable can be placed for handling or shipment than with spools or reels of conventional construction, and an improved spool or reel by which ribbon material or cable of the type above-described can be wound about the barrel thereof between spaced apart flanges as with conventional spools and reels and still have all of the afore-mentioned desired features.

SUMMARY OF THE INVENTION

It is an object of this invention to provide an improved spool or reel.

Another object of the invention is to provide an improved spool or reel for handling and packaging ribbon material or ribbon cable comprising unlimited number of conductors in side by side relation bonded together and having a generally rectangular cross-section.

Another object of the invention is to provide an improved spool or reel for ribbon material or cable by which an optimum amount of material or cable can be placed for handling or shipment without the size of the spool becoming unmanageable in normal operations.

Yet another object of the invention is to provide an improved spool or reel for ribbon material or cable which generally has the exterior geometric configuration of conventional spools and reels;

A further object of the invention is to provide an improved spool or reel for ribbon material or cable on which a larger amount of ribbon material or cable can be placed for handling or shipment than with spools or reels of conventional construction.

Still further another object of the invention is to provide an improved spool or reel for ribbon material or cable by which ribbon cable of the type above-described can be wound about the barrel between spaced apart flanges as with conventional spools and reels and still have all of the afore-mentioned desired features.

Finally, it is an object of the invention is to provide an improved spool or reel for ribbon material or cable which meets all of the above-desired features.

In the broader aspects of the invention there is provided an improved spool or reel for packaging and handling ribbon material or cable. The spool has a cylindrical hub with a central spindle opening extending therethrough, two opposite flange portions, one or more central flange portions. Each of the flange portions is disk shaped and radially extends outwardly from the hub.

BRIEF DESCRIPTION OF THE DRAWINGS

The above mentioned and other features and objects of this invention and the manner of obtaining them will become more apparent and the invention itself will be better understood by reference to the following description of an embodiment of the invention taken in conjunction with the accompanying drawing wherein.

DESCRIPTION OF A SPECIFIC EMBODIMENT

Figure 1:
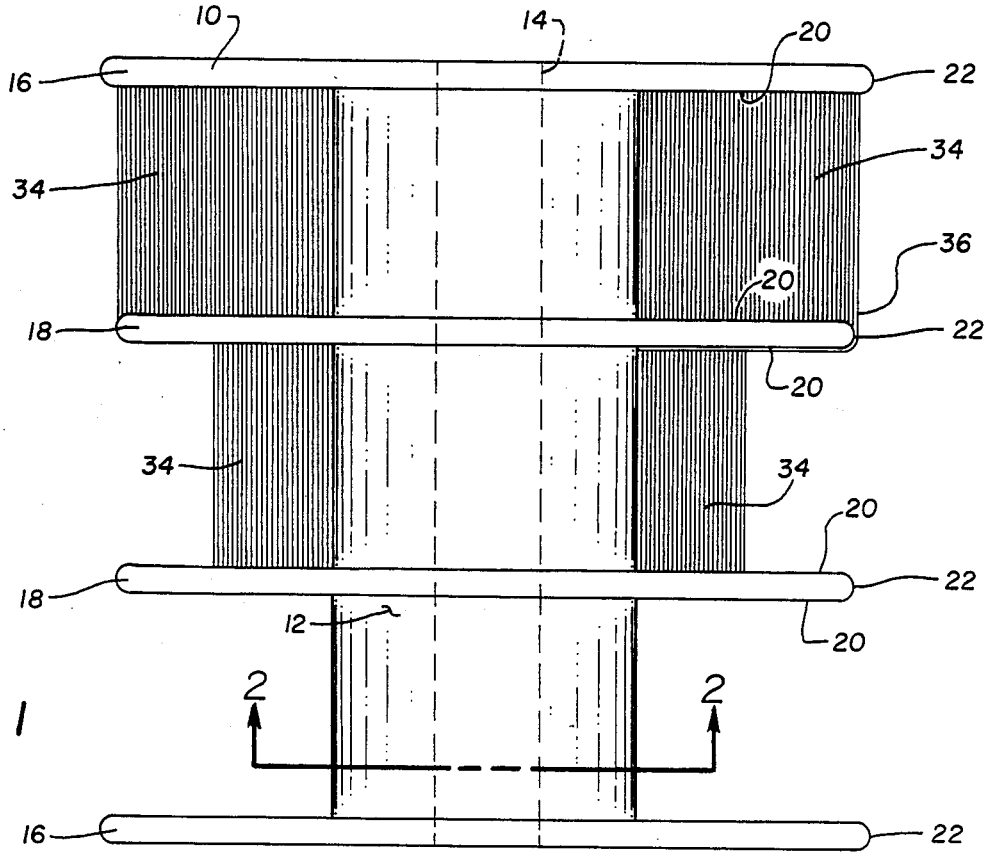
FIG. 1 is a side view of the improved reel or spool of the invention.
Figure 2:
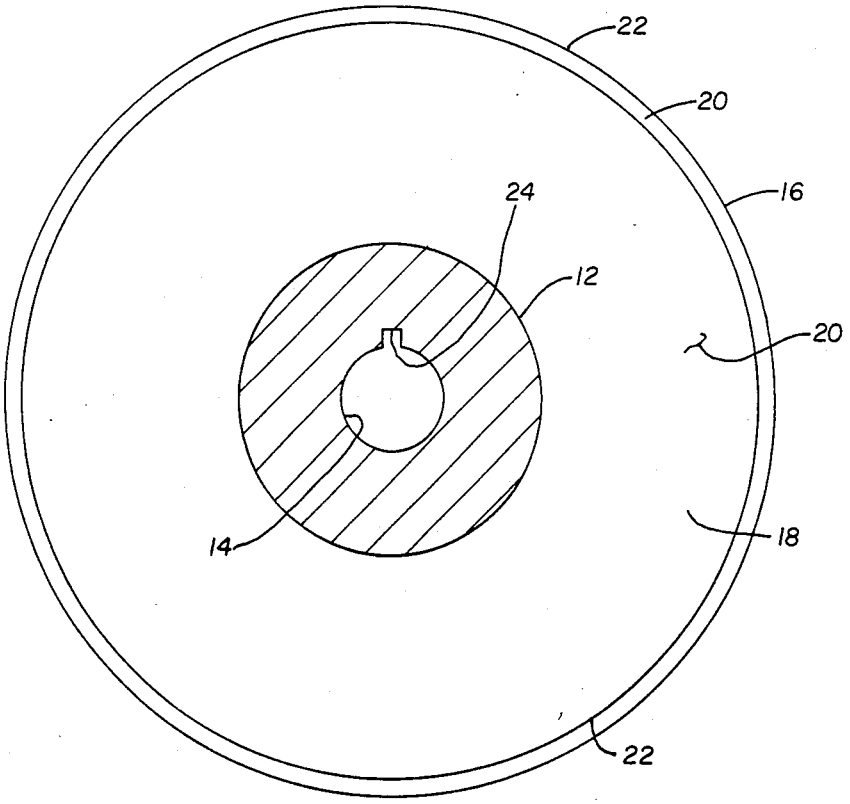
FIG. 2 is a cross-sectional view of the reel or spool shown in FIG. 1 taken substantially along the section line 2—2.

Referring to FIGS. 1 and 2, the spool and reel of the invention is shown to have a cylindrical barrel 12 having a coaxial and centrally located cylindrical opening 14 for a spindle and opposite end flanges 16 radially extending from the barrel 12. Opening 14 is keyed at 24 so as to allow reel or spool 10 to be driven or braked, as desired. Spaced from end flanges 16 and positioned therebetween is at least one middle flange 18. Two spaced apart middle flanges 18 are shown in FIGS. 1 and 2. Middle flanges 18 radially extend from the barrel 12 and are generally parallel to flanges 16 and each other.

Flanges 16 and 18 each have generally flat and smooth surfaces 20 which guide the material positioned on the reel or spool 10 in and out of position upon filling and emptying the spool or reel. Flange surfaces 20 are each generally planar and parallel to each other. Additionally, flanges 16 and 18 each have smoothly rounded end surfaces 22 against which the material being placed on or taken off from the spool or reel may also be guided into or out of position. Thus, in a specfic embodiment used for ribbon cable the surfaces 20 and the ends 22 each are finished with a surface designed to minimize damage to the cable being placed on or taken off from the spool or reel.

In the specific embodiment illustrated in FIGS. 1 and 2, reel 10 has two middle flanges 18. However, in other specific embodiments, the spools and reels of the invention may have one or may have more than two middle flanges, as desired.

Figure 3:
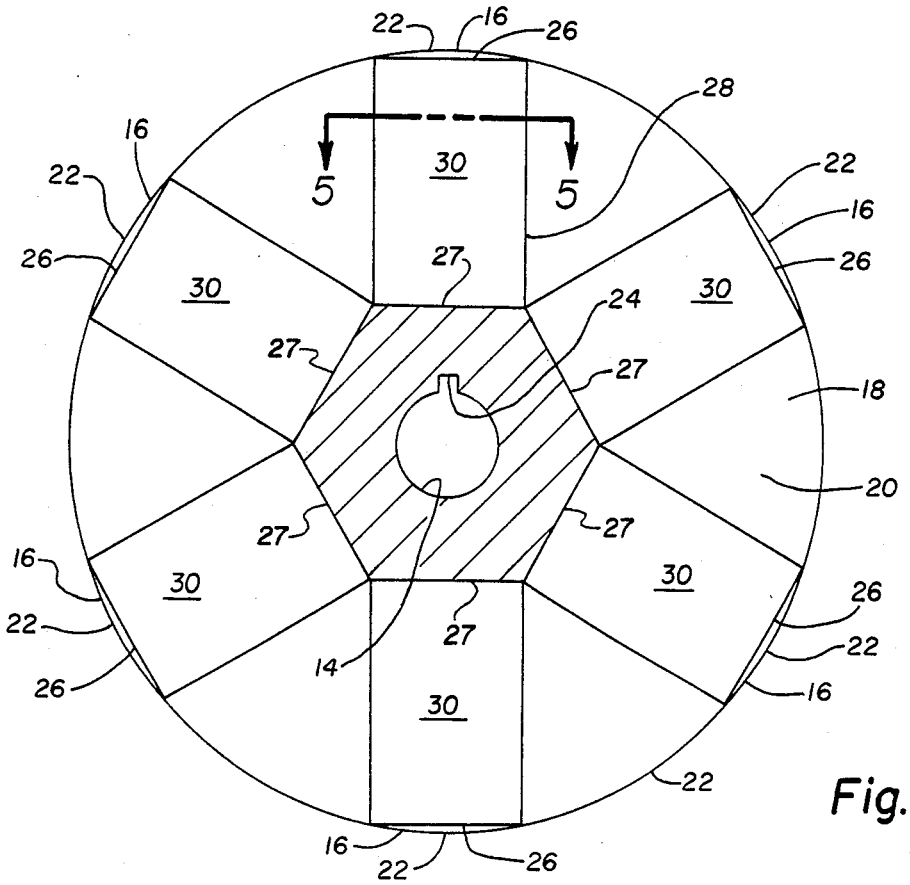
FIG. 3 is a cross-sectional view like FIG. 2 showing a reel or spool of the invention having a modified middle flange.
Figure 4:
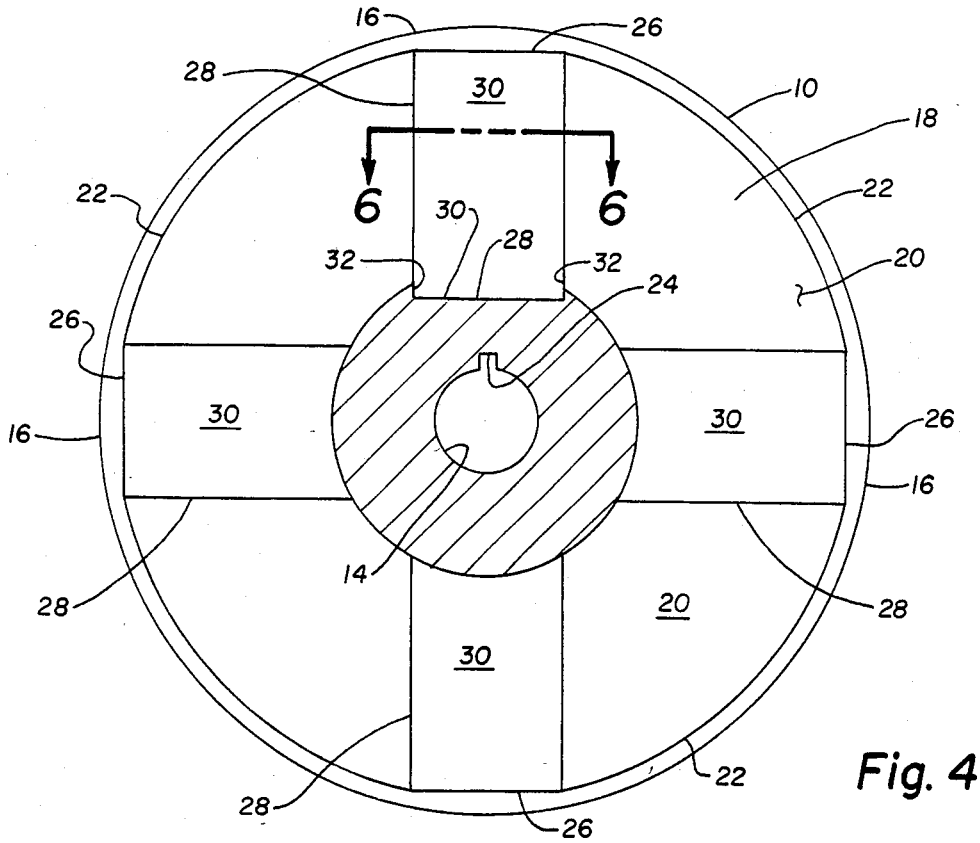
FIG. 4 is a view like FIGS. 2 and 3 showing the construction of a middle flange of yet another spool or reel of the invention.

The middle flanges 18 in the specific embodiment illustrated in FIGS. 1 and 2 have a structure identical with the end flanges 16, but slightly smaller in diameter. The difference in diameter is such that end flanges 16 always protrude radially beyond the material on the spool to protect the material from damage as the spool is being shipped or otherwise handled. In a specific embodiment, the diameters of the middle flanges 18 are smaller than the diameters of the end flanges 16 by at least two times the thickness dimensions of the ribbon material being stored on the spool. FIGS. 3 and 4 illustrate middle flanges having different structures.

Figure 5:
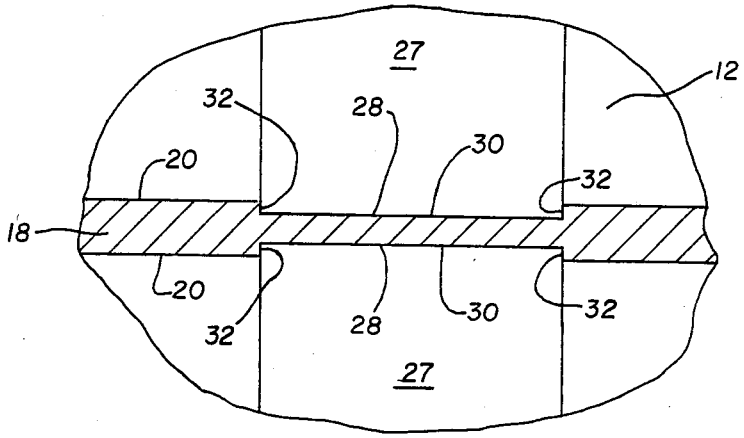
FIG. 5 is a fragmentary and cross-sectional view taken substantially along section line 5—5 of FIG. 3.

FIGS. 3 and 5 illustrate a middle flange 18 which has a diametral size equal to flanges 16. Thus, rounded edges 22 are spaced from barrel 12 the same distance as with flanges 16. However a plurality of flattened surfaces 26 are formed on the flange 18 at spaced apart locations. Each of the flattened surfaces 26 extend between the flange surfaces 20 and are parallel to the axis of the spool or reel 10. Each intersection of the surfaces 26 with a surface 20 defines a geometric chord with respect to the circular shape of the edge 22 of the flange 18.

Similarily, a plurality of flat surfaces 27 are formed on the surface of the barrel 12 at spaced apart locations. Each of the flat surfaces 27 extend between flange surfaces 20 of adjacent flanges 16 or 18. As shown in cross-section in FIG. 3, each surface 27 defines a geometric chord with respect to the circular shape of the barrel 12 and each surface 27 and 26 have the same dimension in cross section and are aligned such that the chords defined by surfaces 26 are spaced apart, but overlie and are co-extensive with the chords defined by surfaces 27, respectively.

Extending radially between each surface 26 and its underlying surface 27 on the barrel 12 on one or both sides of the middle flange 18 is a groove 28. Grooves 28 have a flat bottom 30 and upstanding sides 32. Bottom 30 is generally perpendicular to surfaces 26 and 27 and sides 32. Bottom 30 is generally parallel to surfaces 20. Sides 32 are generally parallel to the axis of the spool or reel. The distance between sides 32 and the length of the surface 26 and the width of surface 27 are generally determined by the width of the ribbon material being stored or packaged on the reel or spool 10 of the invention. In a specific embodiment, bottoms 30 are spaced from surfaces 20 a distance equal to at least two times the thickness dimension of the material being stored on the spool. Six (6) chordal surfaces 26 and 27 and twelve (12) such grooves 28 are shown on the middle flange 18 and the barrel 12 illustrated in FIG. 3. The maximum number of chordal surfaces 26 and 27 and grooves 28 depends upon the diameter of the middle flange 18 and the width of the ribbon material being stored or packaged on the spool or reel 10.

At a minimum, only two grooves 28, one in each of the flange surfaces 20, are required as only one of the grooves 28 of the middle flange 18 illustrated in FIG. 3 will be used each time the spool or reel is filled with ribbon material. In another specific embodiment, the minimum two grooves 28 each have their own surfaces 26 and 27.

FIG. 4 shows still another middle flange of the spool or reel 10 of the invention. Middle flange 18 has an exterior diameter slightly less than flanges 16 like the middle flange 18 shown in FIG. 2. However, differing from the flange 18 illustrated in FIG. 2, flange 18 illustrated in FIG. 4 has formed therein cordal surfaces 26 and grooves 28 in the oppositely facing flange surfaces 20 and in barrel 12 as afore-described with regard to the middle flange illustrated in FIG. 3.

Figure 6:
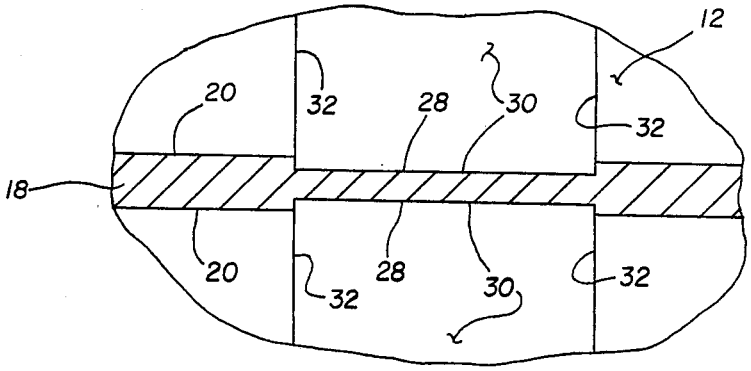
FIG. 6 is a fragmentary and cross-sectional view taken along line 6—6 of FIG. 4.

In yet another specific embodiment, grooves 28 are formed in the barrel 12 in lieu of flat surfaces 27 as shown in FIG. 4. In essence, flat surfaces 27 are positioned beneath the cylindrical surface of the barrel 12 a distance equal to at least two times the thickness dimension of the material being stored on the spool and become groove bottom 30. Barrel grooves 28 extend between flanges and otherwise have all of the structure of flange grooves 28. FIG. 6 illustrates both flange grooves 28 and barrel grooves 28. In a view similar to FIG. 6 of the remaining flange grooves 28 of the middle flange of FIG. 4, flange grooves 28 appear as shown in FIG. 5 without the demarcation of surfaces 27.

While the drawings illustrate sharp corners where the surfaces 26, 27, 30, 32 and the surface of barrel 12 intersect, in the specific embodiments of the spool or reel of the invention used to store or ship ribbon cable of the type in which a plurality of insulated magnet wire conductors are juxtaposed in a side by side relation, these corners are radiused so as to support a 90 degree fold of the ribbon cable stored on the spool or reel consistently with the flexibility specification of the ribbon cable. As is well known, the flexibility of magnet wire is tested throughout the industry by wrapping the magnet wire about a mandrel causing the magnet wire to be folded about a specified radius without damage to the insulation of the wire. Each of the aforementioned corners are radiused either in accordance with such specifications or by larger radiuses such that magnet wire folded over such radiuses will not be damaged or otherwise rendered unusable.

In operation, the spool or reel 10 of the invention can be used to store or package for shipment ribbon material as above-mentioned. The spool or reel 10 of the invention is provided with one or more annular spaces 34 in which ribbon material can be placed for handling or shipping. In take-up, a first space 34 adjacent to one of the end flanges 16 is filled with ribbon material. The material is then passed over the middle flange 18 and is positioned within the next adjacent space 34. As the ribbon material 36 passes over the middle flange 18, ribbon material is superimposed on the middle flange prior to the first lap of ribbon material around the barrel 12 in the next adjacent space 34. Similarly, when the second space 34 is filled, the ribbon material is moved to the adjacent space 34 in the same manner as above described.

Specifically, the ribbon material or cable 36 stored on the spool or reel of the invention undergoes four approximately 90 degree changes in direction as it passes from one annular space 34 to an adjacent annular space 34. Each of these changes in direction are accomplished by a fold which extends approximately 45 degrees or 90 degrees to the longitudinal direction of the ribbon material or cable. As the ribbon material or cable is wound on the spool or reel 10 and upon filling the first annular space 34, the ribbon material or cable longitudinally extends perpendicularly of the axis of the spool or reel. A 90 degree change in direction in the ribbon material or cable is accomplished in order to position the longitudinal direction of the ribbon material or cable so as to extend generally parallel to the axis of the spool such that the ribbon material or cable extends toward a middle flange 18. This 90 degree change in direction is accomplished by a fold which extends approximately 45 degrees to the longitudinal direction of the ribbon material or cable. The ribbon material or cable then passes over edge 22 or the surface 26, as the case may be, of the middle flange 18 and undergoes a second 90 degree change in direction so as to overlay the flange surface 20 or the bottom 30 of a flange groove 28, as the case may be, and to position the longitudinal direction of the ribbon material or cable again perpendicular to the axis of the spool or reel 10. This 90 degree change in direction is accomplished by a fold which extends generally perpendicularly to the longitudinal direction of the ribbon material or cable.

The ribbon material or cable at the base of the middle flange 18 undergoes a third approximately 90 degree change in direction so as to position the longitudinal direction of the ribbon material or cable generally parallel to the axis of the spool and to overlay the ribbon material or cable on the barrel 12 or on a surface 27 or 30, as the case may be. This 90 degree change in direction is also accomplished by a fold which extends generally perpendicularly to the longitudinal direction of the ribbon material.

A final and fourth 90 degree change in direction is accomplished on the surface of the barrel 12 or surfaces 27 or 30, as the case may be, so as to position the longitudinal direction of the ribbon material or cable again generally perpendicular to the axis of the spool and to align the ribbon material or cable within the adjacent annular space 34 between the flange surfaces 20 such that the spool or reel 10 may be rotated to take up additional ribbon material or cable to fill adjacent annular space 34. This 90 degree change in direction is accomplished by a fold approximately 45 degrees to the longitudinal direction of the ribbon material or cable.

A specific description of the four 90 degree changes in direction of the ribbon material or cable upon pay out is merely the reverse of that above described upon take up.

In the spool illustrated in FIGS. 1 and 2, the material 36 may extend over the middle flange at any circumferential position thereon and in some cases the exposed portion of the ribbon material will be protected from damage by the larger end flanges 16.

In spools in which the middle flange is illustrated in FIGS. 3 and 4 are utilized, the material 36 is positioned on one of the chordal surfaces 26, in one of the grooves 28, or on surfaces 27, as it passes between adjacent spaces 34 of the spool or reel 10. Again, the exposed portion of the ribbon material 36 is protected from damage by the larger end flanges 16, the radiused corners and by the surfaces of the flange 18 and barrel 12. By means of the grooves 28 and the surfaces 26 and 27, the ribbon material is always superimposed on the flat surfaces 26, 27 or 30 or radiused surfaces, and is further protected by the flange or barrel surfaces as the groove edges 32 are larger in width than the width of the ribbon material 36.

While a specific embodiment of the invention has been shown and described herein for purposes of illustration, it is desired that the protection afforded by any patent which may issue upon this application not be limited strictly to the disclosed embodiment; but that it extend to all structures and arrangments and methods and articles which contain the essence of the invention and which fall within the scope of the claims which are appended herein.

What is claimed is:

1. A spool for ribbon cable or material comprising a cylindrical barrel, said barrel having a cylindrical spindle opening extending therethrough, two oppositely disposed end flanges extending radially from said barrel, said end flanges being spaced apart by said barrel, said end flanges being generally perpendicular to said barrel and generally parallel to each other, and at least one middle flange extending radially from said barrel, said middle flanges being generally perpendicular to said barrel and generally parallel to each other and to said end flanges, each of said middle flanges having a smoothly rounded perimetral edge, said middle flange edges and said cylindrical barrel and spindle opening being coaxial, said end and middle flanges each having one or two flange surfaces facing the flange surfaces of another flange, each of said flange surfaces and said middle flange edge being a ribbon guiding surface having a smooth finish thereon which is in contact with said ribbon cable or material upon pay-out and take-up operations whereby a plurality of annular spaces are defined for storage of a continuous length of ribbon cable or material between said end flanges.

2. The spool of claim 1 further comprising an elongated ribbon cable or material wound about said barrel between one of said end flanges and said middle flange, said material being folded to extend over said perimetral edge of said middle flange and being folded to extend over the surface of said middle flange facing the other of said end flanges, said material being folded to extend over said barrel and being folded to be positioned between said middle flange and the next adjacent flange, said ribbon material being wound around said barrel between said middle and next adjacent flanges.

3. The spool of claim 1 wherein said middle and end flanges are each circular in cross-sections taken generally perpendicular to the spool axis, and at least one of said middle flanges has a diameter which is smaller than the diameters of said end flanges by at least two times the thickness dimension of the ribbon cable or material being stored on the spool.

4. The spool of claim 1 wherein said middle and end flanges are each circular in cross-sections taken generally perpendicular to the spool axis, and at least one of said middle flanges have at least one flattened peripheral portion defining a flat surface generally parallel to the spool axis, said flat surface defining a geometric chord in said cross-sections of said one flange.

5. The spool of claim 4 wherein said one middle flange has a groove therein extending from said flat surface to said barrel, said groove having a bottom and upstanding spaced-apart opposite sides, said bottom being generally perpendicular to said flat surface and the spool axis, the distance between said groove sides being equal to the length of said chord, said bottom spaced from the surface of said one middle flange by a distance equal to at least two times the thickness dimension of the material being stored on the spool.

6. The spool of claim 4 wherein said middle flanges have a diameter which is smaller than the diameters of said end flanges by at least two times the thickness dimension of the material being stored on the spool.

7. The spool of claim 4 wherein said one middle flange has a plurality of spaced-apart flattened peripheral portions defining a plurality of spaced-apart flat surfaces generally parallel to the spool axis, said flat surfaces defining geometric chords in said cross-sections of said one flange.

8. The spool of claim 7 wherein said one middle flange has a plurality of grooves therein, one of said grooves extending between each of said flat surfaces and said barrel, said grooves each having a bottom and upstanding spaced-apart opposite sides, said bottom being generally perpendicular to said flat surface and the spool axis, the distance between said groove sides being equal to the length of said chord, said bottom spaced from the surface of said one middle flange by a distance equal to at least two times the thickness dimension of the material being stored on the spool.

9. The spool of claim 8 wherein said one middle flange has two oppositely facing flange surfaces, and some of said grooves are in one of said two surfaces and the other of said grooves are in the other of said two surfaces.

10. The spool of claim 7 wherein said one middle flange has two oppositely facing flange surfaces and a plurality of grooves therein, two of said grooves extending between each of said flat surfaces and said barrel, said grooves each having a bottom and upstanding spaced-apart opposite sides, said bottom being generally perpendicular to said flat surface and the spool axis, the distance between said groove sides being equal to the length of said chord, said bottom spaced from the surface of said one middle flange by a distance equal to at least two times the thickness dimension of the material being stored on the spool, one of said two grooves of each flat surface being in one of said two flange surfaces, the other of said two grooves of the same flat surface being in the other of said two flange surfaces.

11. The spool of claim 10 wherein said middle flanges have a diameter which is smaller than the diameters of said end flanges by at least two times the thickness dimension of the material being stored on the spool.

12. The spool of claim 1 wherein said barrel has at least one flat surface thereon, said flat surface extending between adjacent flanges, said flat surface having a width generally equal to the width of the material being stored on the spool, said flat surface being generally parallel to said spool axis.

13. The spool of claim 4 wherein said barrel has a barrel flat surface thereon, said flat surface extending between adjacent flanges, said flat barrel surface having a width generally equal to the length of said geometric chord of said flange flat surface, said flange and barrel flat surfaces being generally parallel and aligned so that the opposite ends of said flange flat surface and the sides of said barrel flat surface define two parallel planes which are spaced apart and parallel to said spool axis.

14. The spool of claim 12 or 13 wherein said, flat flange surface defines a corner with said flange surfaces and said flat barrel surface defines a corner with the surface of said barrel, said corners being radiused to support the material being stored in said spool in accordance with the flexibility specification of said material.

15. The spool of claim 13 wherein said flat barrel surface is spaced beneath said barrel surface a distance equal to at least two times the thickness dimension of the material being stored on the spool.

* * * * *

UNITED STATES PATENT AND TRADEMARK OFFICE

CERTIFICATE OF CORRECTION

PATENT NO. : 4,569,491

DATED : June 24, 1986

INVENTOR(S) : Daniel P. Dietzler

It is certified that error appears in the above-identified patent and that said Letters Patent are hereby corrected as shown below:

In the table on the page with Cols. 13 and 14, "TEST NO. 1", under "COMMENT", please move "Portion of of weld bead broke" to be the "COMMENT" opposite the "LOAD (lbs.)" amount of "14000".

In the table on the page with Cols. 13 and 14, "TEST NO. 1", under "COMMENT", please move "Max. Load. Test Stopped" to be the "COMMENT" opposite the "LOAD (lbs.)" amount of "15000".

In the table on the page with Cols. 13 and 14, "TEST NO. 2", under "COMMENT", please move "Reached strain capacity of test machine" to be the "COMMENT" opposite the "LOAD (lbs.)" amount of "1800".

In the table on the page with Cols. 13 and 14, "TEST NO. 3", under "COMMENT", please move "Reached strain capacity of test machine." to be the "COMMENT" opposite the "DEFLECTION (in.)" amount of "3.17±" in the table on the page with Cols. 15 and 16.

In the table on the page with Cols. 15 and 16, "TEST NO. 4", under "COMMENT", please move "±5% Deflection", to be the "COMMENT" opposite the "LOAD (lbs.)" amount of "2250".

In the table on the page with Cols. 15 and 16, "TEST NO. 4", under "COMMENT", please move "Reached strain capacity of test machine." to be the "COMMENT" opposite the "LOAD (lbs.)" amount of "5900".

In the table on the page with Cols. 15 and 16, "TEST NO. 5", under "COMMENT", please move "±5% Deflection", to be the "COMMENT" opposite the "LOAD (lbs.)" amount of "3300".

UNITED STATES PATENT AND TRADEMARK OFFICE

CERTIFICATE OF CORRECTION

PATENT NO. : 4,569,491

DATED : June 24, 1986

INVENTOR(S) : Daniel P. Dietzler

It is certified that error appears in the above-identified patent and that said Letters Patent are hereby corrected as shown below:

In the table on the page with Cols. 15 and 16, "TEST NO. 6", under "COMMENT", please move "Reached strain capacity of test machine." to be the "COMMENT" opposite the "LOAD (lbs.)" amount of "5000".

In the table on the page with Cols. 15 and 16, "TEST NO. 7", under "COMMENT", please move "Stem buckling visible." to be the "COMMENT" opposite the "LOAD (lbs.)" amount of "10500".

In the table on the page with Cols. 15 and 16, "TEST NO. 7", under "COMMENT", please move "Sudden collapse of pipe. Stem shattered." to be the "COMMENT" opposite the "LOAD (lbs.)" amount of "17200".

In the table on the page with Cols. 15 and 16, "TEST NO. 8", under "COMMENT", please move "Failure - bead broke away from stem." to be the "COMMENT" opposite the "LOAD (lbs.)" amount of "12200".

In the table on the page with Cols. 15 and 16, "TEST NO. 9", under "COMMENT", please move "Reached strain capacity of test machine." to be the "COMMENT" opposite the "LOAD (lbs.)" amount of "1350".

In the table on the page with Cols. 15 and 15, "TEST NO. 10", under "COMMENT", please move "Max. load." to be the "COMMENT" opposite

UNITED STATES PATENT AND TRADEMARK OFFICE

CERTIFICATE OF CORRECTION

PATENT NO. : 4,569,491

DATED : June 24, 1986

INVENTOR(S) : Daniel P. Dietzler

It is certified that error appears in the above-identified patent and that said Letters Patent is hereby corrected as shown below:

the "LOAD (lbs.)" amount of "4175".

Signed and Sealed this

Twelfth Day of April, 1988

*Attest:*

DONALD J. QUIGG

*Attesting Officer*

*Commissioner of Patents and Trademarks*